United States Patent [19]

Su

[11] Patent Number: 5,029,728

[45] Date of Patent: Jul. 9, 1991

[54] METHOD AND APPARATUS FOR DISPENSING PACKAGING BAGS

[75] Inventor: Philip P. Su, Greer, S.C.

[73] Assignee: W. R. Grace & Co.-Conn., Duncan, S.C.

[21] Appl. No.: 455,530

[22] Filed: Dec. 22, 1989

[51] Int. Cl.[5] ..... B65B 43/18; B65B 43/14; B65H 5/08

[52] U.S. Cl. ..... 221/211; 221/224; 221/232; 53/571; 271/98; 271/107

[58] Field of Search ..... 53/512, 571, 573, 579, 53/570; 221/211, 225, 232, 270, 224; 271/98, 102, 107, 140, 175, 306, 189, 196

[56] References Cited

U.S. PATENT DOCUMENTS

| | | | |
|---|---|---|---|
| 3,407,567 | 10/1968 | Hudson | 53/573 X |
| 4,186,918 | 2/1980 | Ficker et al. | 271/98 X |
| 4,291,517 | 9/1981 | Lipes | 53/573 X |
| 4,453,708 | 6/1984 | Dennhardt | 271/98 X |
| 4,540,167 | 9/1985 | Tamura et al. | 271/107 X |
| 4,586,320 | 5/1986 | Takai et al. | 53/512 |
| 4,843,796 | 7/1989 | Furukawa | 53/571 X |

*Primary Examiner*—Horace M. Culver

*Attorney, Agent, or Firm*—John J. Toney; Mark B. Quatt; William D. Lee, Jr.

[57] ABSTRACT

Packaging apparatus and a method therefor, comprise a bag dispenser in which a stack of bags is supported on extensible wicket pegs and the leading bag is advanced from the stack to bag-receiving wicket pegs of bag-receiving retainer means while the extensible parts of the wicket pegs of the stack holder means are extended into engagement with the wicket pegs of the bag-receiving retainer means. In that configuration a suction pad can draw the nearest bag from the rest of the stack to a separated position from which it may be further advanced by mechanical means and/or an air jet to pass that bag from the extensible wicket pegs of the stack holder means on to the wicket pegs of the bag retainer means. The bag dispensing apparatus may comprise part of a packaging apparatus.

7 Claims, 4 Drawing Sheets

METHOD AND APPARATUS FOR DISPENSING PACKAGING BAGS

FIELD OF THE INVENTION

The present invention relates to the dispensing of packaging bags from a supply, and is in particular concerned with the dispensing of individual bags from a stack of "wicketed" bags (i.e. bags which normally have one side wall longer than the other with usually two spaced holes in the projecting part of the longer wall to allow the stack of bags to be held on a corresponding number of, e.g. two, "wicket" pegs).

PRIOR ART

Wicketed bags are normally used by loading the top horizontal bag of a stack while the stack is held on the wicket pegs and then tearing that loaded bag from the wicket pegs, before closing the bag, to rupture the holes formed for the pegs.

OBJECTS OF THE INVENTION

It is an object of this invention to provide for dispensing of the bags one at a time in unbroken condition for subsequent filling and closing as needed for packaging purposes.

SUMMARY OF THE INVENTION

Accordingly, a first aspect of the present invention provides apparatus for dispensing packaging bags from a wicketed bag stack, comprising: stack holder means including wicket pegs extensible between a retracted position in which the wicket pegs are long enough to support the stack of bags and an extended position in which the wicket pegs are projected further beyond the stack; a bag retainer including wicket pegs which have a spacing and a size corresponding to those of the stack holder means; means indexing said bag retainer means to and from a bag-receiving position in which said wicket pegs of the bag retainer means are coaxial with those of the stack holder means and are a continuation of them in the extended position; and means for separating from a stack held by the stack holder means the first bag which is nearer the bag-receiving position of said bag retainer means and for transporting said bag along the wicket pegs of the stack holder means while in their extended configuration, to pass directly on to the coaxial and engaging respective wicket pegs of the bag retainer means.

A second aspect of the present invention provides a method of delivering individual bags from a wicketed stack of bags, comprising supporting the wicketed stack on extensible wicket pegs, extending the wicket pegs to engage further wicket pegs on to which bags are to be received, and urging the first bag or a set of bags of said stack along the extended wicket pegs to said further wicket pegs.

A third aspect of the present invention also provides a vacuum packaging apparatus comprising at least one first chamber portion associated with bag-receiving wicket pegs to support an individual bag to be closed in said chamber portion; a second chamber portion adapted to engage the first chamber portion to define a closed chamber in which a bag on said wicket pegs may be evacuated and closed; and bag dispensing apparatus according to the first aspect wherein said wicket pegs of the bag retainer means are those associated with the first chamber portion.

BRIEF DESCRIPTION OF THE DRAWINGS

In order that the present invention may more readily be understood the following description is given, merely by way of example, with reference to the accompanying drawings in which.

DETAILED DESCRIPTION OF THE INVENTION

Figure 1:
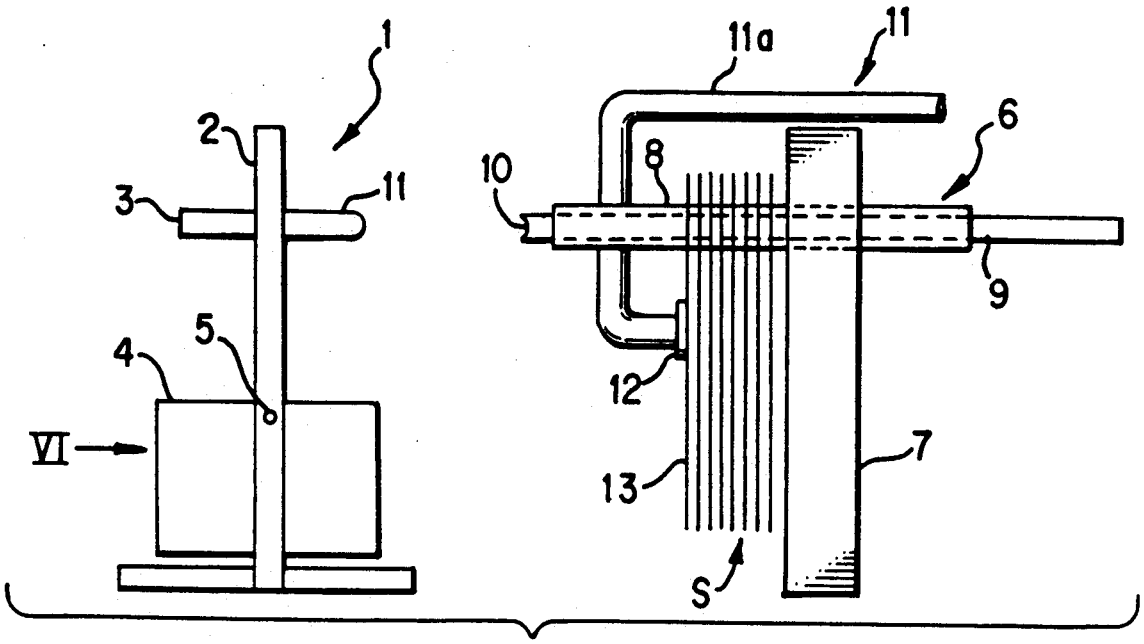
FIG. 1 shows a schematic side elevational view of one embodiment of bag dispensing apparatus in accordance with the present invention, at the start of an operating cycle.

Referring now to FIGS. 1 to 5, these show a bag retainer means 1 as comprising a pair of uprights 2 supporting near their upper ends a pair of bag-receiving wicket pegs 3 and near their lower ends a bucket 4 positioned between the uprights 2 and pivoted on journals 5. The bucket 4 is thus able to swing about the horizontal axis defined by the journals 5, to facilitate loading and/or discharging of the bag into and out of the bucket 4.

The stack holder means 6 of the dispensing apparatus comprises a frame 7 supporting a pair of tubular wicket peg outers 8 which each slidably receives a wicket peg inner 9 having at its left hand end a concavity 10 to mate with a corresponding convexity 11 on the opposing end of the corresponding bag-receiving wicket peg 3 of the bag retainer means 1.

Figure 6:
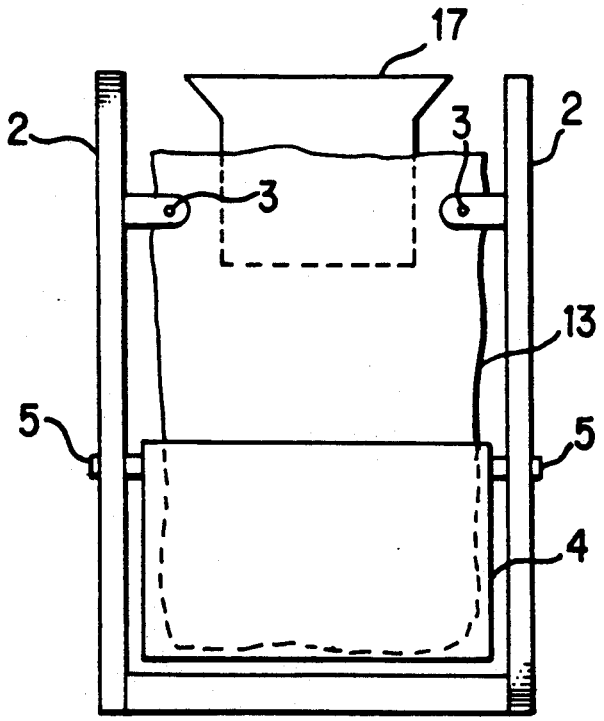
FIG. 6 shows a front elevational view of the bag retainer and bucket assembly, during filling of the bag.

The embodiment of bag dispensing apparatus shown is used in a packaging process in which fluent product is discharged into the open upper end of the bag, and thus the bucket 4 serves as a retainer to both support the weight of the product in the bag after loading, and to define the shape of the product-enclosing lower portion of the bag. This will be appreciated later by reference to FIG. 6 showing a view of the retainer means 1 of FIG. 1 as seen along the direction VI thereof.

Throughout the packaging process the retainer means 1 supports the bag while it is first loaded, then preferably evacuated, and finally closed. The journals 5 enable the bucket 4 to discharge the closed bag at the end of the packaging process.

In order to dispense the wicketed bags individually from a stack S on the wicket peg outers 8 of FIG. 1, a movable bag delivery tube 11 is provided with a suction pad 12 to suck the left hand bag 13 of the stack S so that when the horizontally extending portion 11*a* of tube 11 moves leftwardly in an orientation in which the perpendicularly extending limb 11*b* of the tube extends vertically downwardly, the left hand most bag is carried in a leftward direction. This motion is illustrated by comparing FIGS. 1 and 2.

Figure 2:
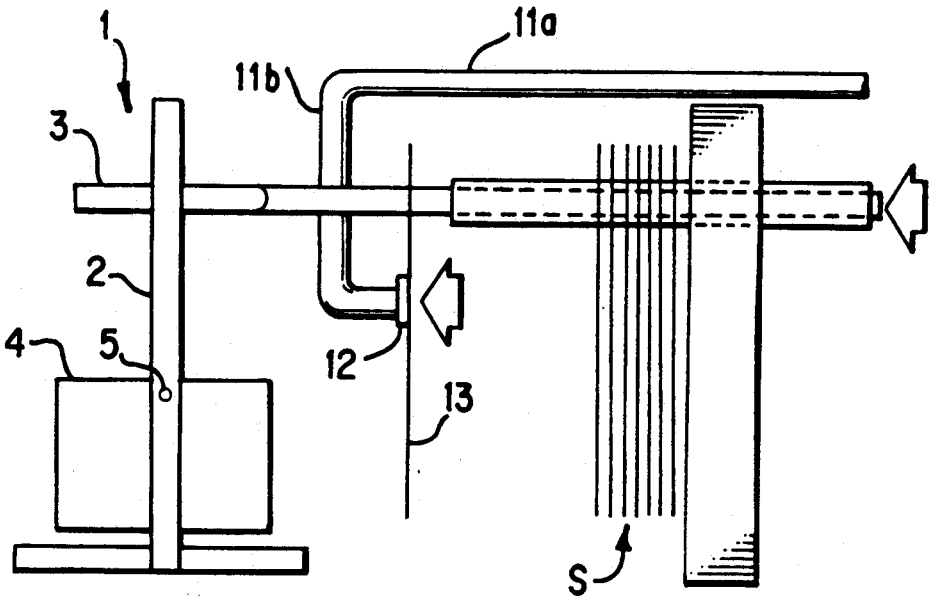
FIGS. 2, 3, 4 and 5 illustrate the apparatus of FIG. 1 at various successive stages during the operating cycle.

FIGS. 1 and 2 also show that before or during this leftward motion of the bag delivery tube 11 the wicket peg inners 9 are displaced leftwardly, by means not shown, to abut and to form a continuation of the bag-receiving wicket pegs 3 of the retainer means 1. Thus the bag 13 is able to slide off the end of the bag-dispensing wicket peg outers 8 on to the wicket peg inners 9 and can be supported all the way to its position in register with the bucket 4 of the retaining means 1.

Figure 3:
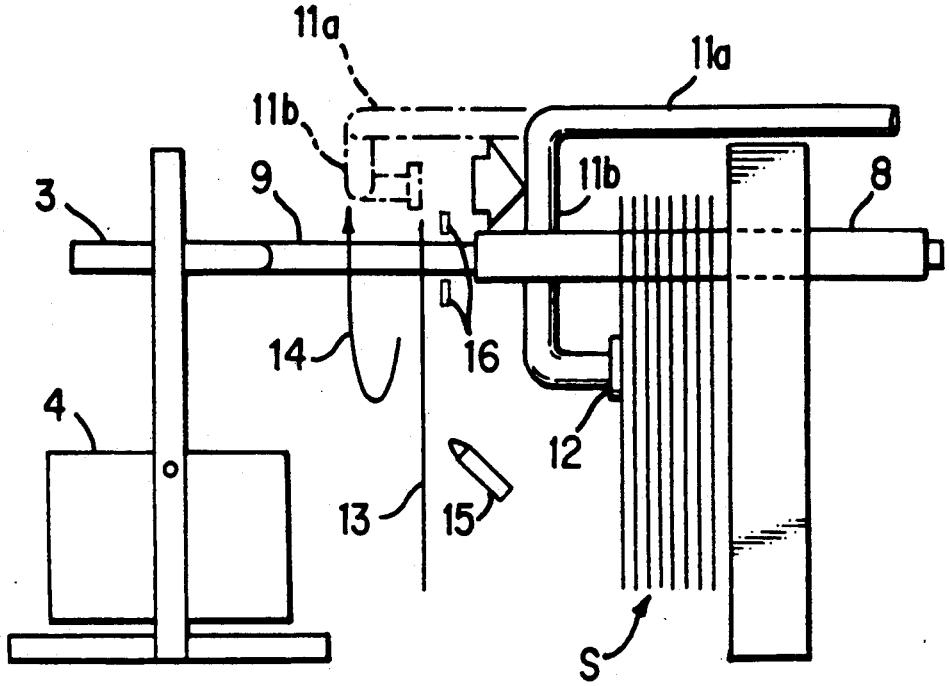

Reference to FIG. 3 shows that during the motion of the bag 13 along the wicket peg inners 9 an air nozzle 15, either positioned closely alongside the path of the bag 13 or movable into the path after the bag 13 has passed by, is now positioned behind the bag 13 while suction through the tube 11 and to the pad 12 is deactivated to release the pad 12 from the bag and to allow rotation of the horizontally extending tube portion 11*a* into a position where the perpendicularly extending tube portion 11*b* has become sufficiently far displaced from its horizontal configuration, by movement along the path indicated schematically by the arrow 14, to reach the chain dotted line position in FIG. 3. From this position the bag-delivery tube 11 can be retracted to a position behind (i.e. to the right of as viewed in FIG. 3) the bag 13 whereupon rotation of the horizontally extending tube portion 11*a* can occur to bring the pad 12 down into the path of the just-delivered bag 13 so that during the final rightward retracting movement of the tube 11 the pad 12 is brought into contact with the next bag to be dispensed. This position is shown in solid lines in FIG. 3.

Figure 4:
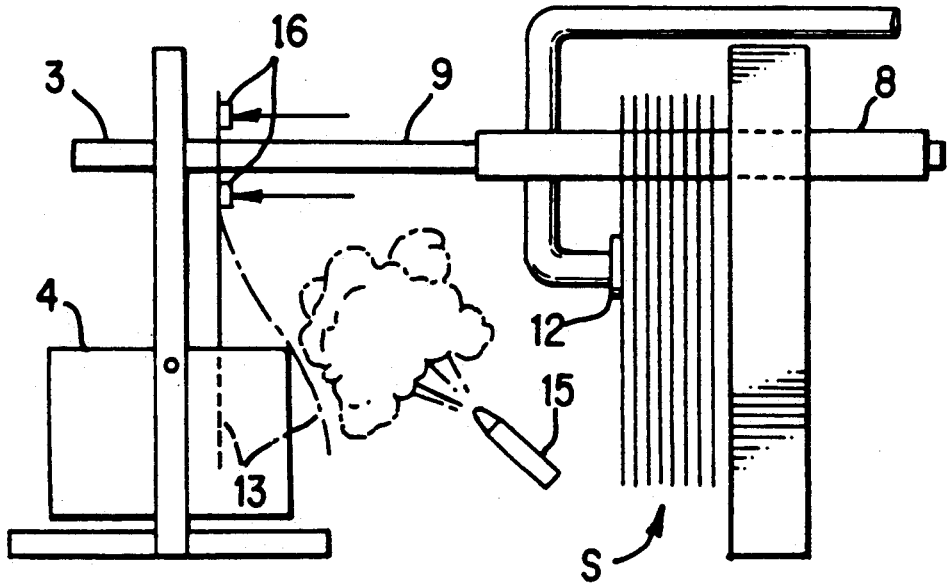

FIG. 3 also illustrates the existence of an optional delivery finger pair 16 to effect positive driving of the upper end of the bag throughout the rest of its movement towards the FIG. 4 position where the upper end of the bag is clearly over the open upper side of the bucket 4.

The closed bottom end of the bag 13 is tucked into the bucket by action of the air jet 15 as shown in FIG. 4. This occurs either at or near the end of the bag-advancing movement of the optional fingers 16.

Figure 5:
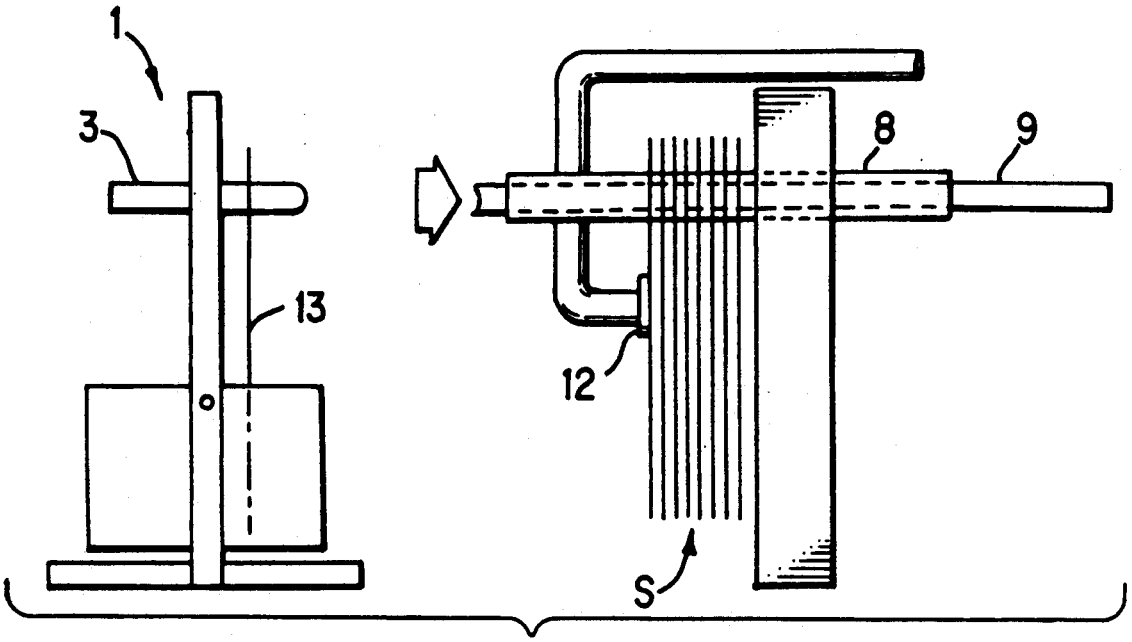

FIG. 5 shows the apparatus after retraction of the wicket peg inners 9, and effectively corresponds to FIG. 1 but with the leading bag 13 now positioned on the bag-receiving wicket pegs 3 of the retainer means 1.

Where the bag-delivery finger pair 16 is omitted, the air nozzle 15 will be expected to achieve the dual functions of both completing the delivery movement of the bag on to the bag receiving pegs 3 of the retainer means and tucking the closed bottom end of the bag over the edge of the bucket and into the bucket interior.

For simplicity of description, the bag retainer means has so far been described as an independent entity. In practice, this may either comprise a separate retainer means which is then advanced, with its bag 13, to a filling station and then onward to a closing station, or it may form an integral part of a bag filling and closing apparatus.

Figure 7:
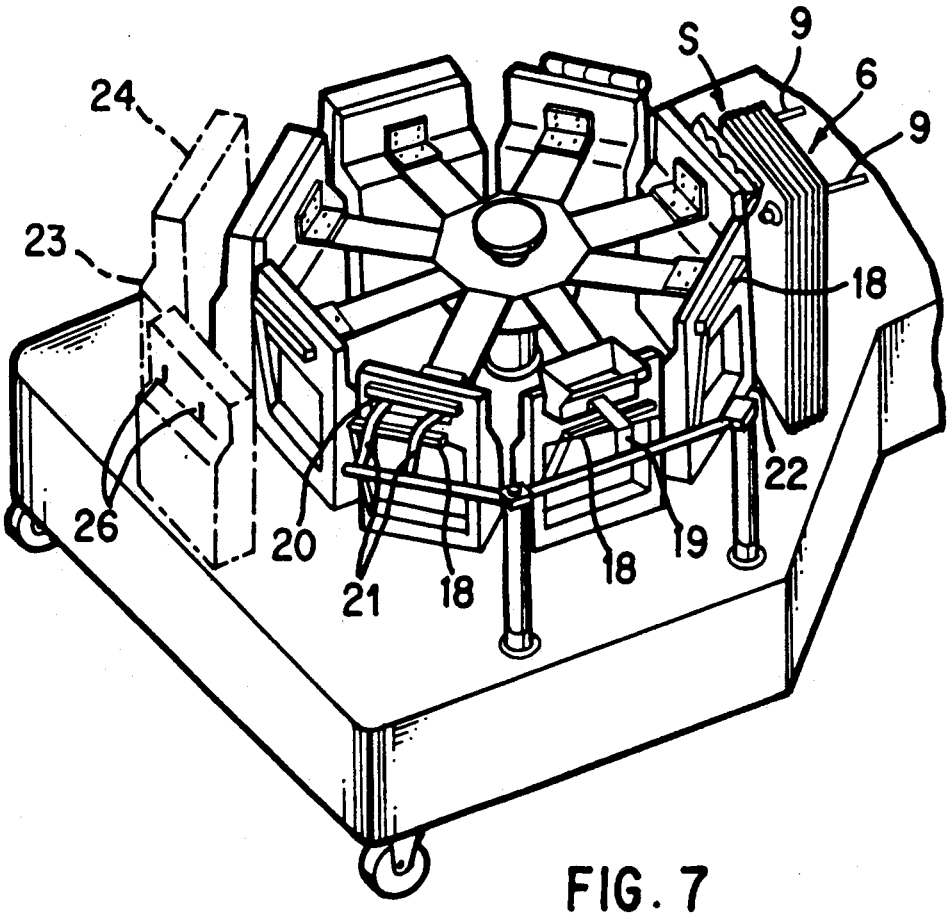
FIG. 7 is a perspective view of a turret type vacuum packaging machine illustrating the bag dispensing apparatus at a bag/infeed station.
Figure 8:
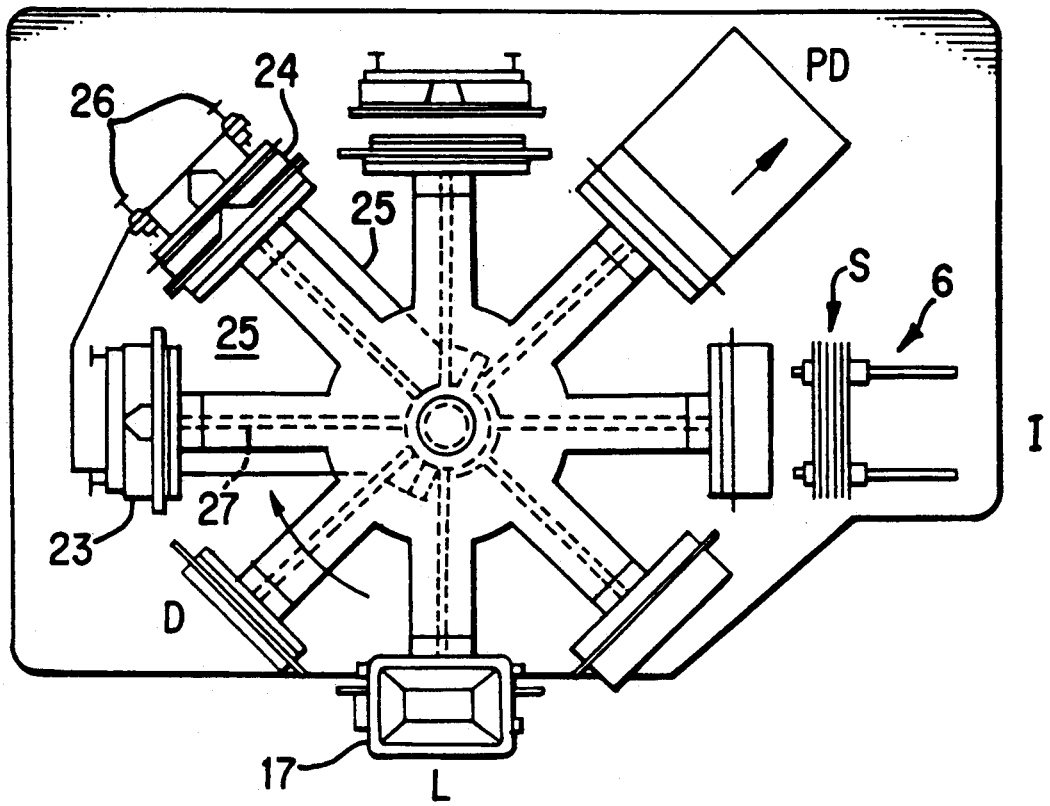
FIG. 8 is an overhead plan view of the packaging apparatus of FIG. 7.

Such bag filling and closing apparatus is shown in FIGS. 7 and 8 where the bag delivery means 6 are shown in schematic form at the bag infeed station I (FIG. 8) of the turret packaging apparatus.

This particular packaging apparatus incorporates the bag retainers as an integral part thereof, although these are omitted from FIGS. 7 and 8 in order to facilitate illustration and description of the other components of the packaging apparatus.

From the bag infeed station I, the turret indexes to bring the transferred bag 13 to a loading station L (FIG. 8) under a product delivery hopper 17 which is also shown in FIG. 6. The bag is captured on the bag-receiving wicket pegs of the retainer means by way of a movable sealing bar 18 which is closed as the radially inner chamber part 22 on the turret leaves the bag infeed station and opens as that chamber part 22 arrives at the loading station L.

On their way to the bag loading station L from the bag infeed station I, the chamber portions undergo a bag detecting operation to ensure that the product loading operation at station L can only occur when a bag is present.

The product loading hopper 17 is supported on a bracket 19 which allows the opening movement of the movable sealing bar 18 so that the neck of the bag is wide open to permit the fluent product which may be liquid, or pulverulent, or in the form of solid chunks for example minced or chopped meat or similar product, to be introduced into the bag.

From the bag loading station L the turret indexes the corresponding chamber portion to a detecting station D (FIG. 8) where a fill detector means 20 indicates if the bag in the chamber has not been filled. The fill detector 20 is supported on brackets 21 such that it allows the movable sealing bar 18 to remain in the open configuration during fill detection and hence allows the fill detector 20 to "look" down into the bag through its open upper end.

The detection station D also includes a jam detector to ensure that the movable seal bar 18 is able to return into the correct position for ensuring that the neck of the bag can be adequately sealed after filling.

Between the detecting station D and a product delivery station PD a pair of radially outer chamber portions 23 and 24 closes onto two adjacent inner chamber parts 22 and travels with them for two increments of rotation of the turret shown in FIGS. 7 and 8.

As the radially inner chamber part 22 moves on from the detecting station D, the movable sealing bar 18 almost closes the neck of the bag still supported on the "wicket" pegs 3 of the bag retainer. The sealing bar 18 retains this position as the two radially outer chamber portions 23 and 24 close on to the inner chamber portions 22.

The first of two successive bags on the turret will therefore continue for about one increment to allow the next following bag to index as far as the detecting station.

The two radially outer chamber portions 23 and 24 (23 being positioned to close substantially at the detecting station D, and 24 being arranged to close at a position displaced from station D by about one increment) are carried on a rotationally oscillating sector 25 which also carries the chamber closing means and other drive means for the radially outer chamber portions.

As the two radially outer chamber portions 23 and 24 are actuated to close, vacuum is applied to the inner chamber portions by way of the vacuum lines 26. As a result the air within the bag is extracted through the narrow neck left open by the only partially closed movable sealing bar 18, and hence simultaneously the two chambers defined by on the one hand the radially outer chamber portion 23 and its associated radially inner chamber portion 22 and, on the other hand, the radially outer chamber portion 24 and its associated radially inner chamber portion 22 are evacuated.

In response to attainment of a desired vacuum level in the two chambers 22, 23 on the one hand and 22, 24 on the other hand, the bag sealing bars 18 are simultaneously energized to seal the bag neck below the wicket holes, thereby completing an evacuated package. At the same time bag cutting mechanisms, which may be either solenoid-actuated or pneumatic ram-actuated, are operated to sever surplus bag material from above the seal lines defined by the seal bars 18.

This operation takes place during indexing of the sector 25 through the position shown in FIG. 8 along a path length of substantially two increments of rotation (90°) so that as the turret approaches the configuration where the outer chamber portion 24 arrives at the package delivery station PD (FIG. 8) the two radially outer chamber portions 23 and 24 will have been moved radially outwardly away from their associated inner chamber portions 22 to release the bags 13 to be supported totally by the floor of the bucket and to liberate the sector 25 and have begun rotation countercurrent to the turret rotation to return to engage the next pair of loaded bags for evacuation and closing.

FIG. 7 shows, in full lines, the pair of outer chamber portions 23 and 24 indexing with the radially inner chamber parts 22, and, in chain dotted lines, the same outer chamber portions 23 and 24 as they return to close on to the next pair of adjacent radially inner chamber parts 22.

As each radially inner chamber portion 22 arrives at the package delivery station PD, the bucket 4 of its bag retainer means is tipped through approximately 90° to place the sealed and loaded bag on its side ready for onward DISPATCH by a package delivery conveyor (not shown).

In the accompanying drawings the bucket 4 of the bag retainer means 1 is shown very schematically and is basically an open-topped rectangular box. In practice the shape of the bucket can be designed at will to suit the particular bag construction and size for which the apparatus is intended to be used.

Only the essential elements of the packaging apparatus have been shown in FIGS. 7 and 8 and hence various items have been omitted, for example the product supply pump and the supply tube which introduces pumped product to the product feed hopper 17, and all the various drive linkages to control rotation of the turret and of the quadrant 25, and to control the radial movement of the outer chamber portions 23 and 24 carried by the turret, a well as to control the actuation of the components such as the seal bar 18 and the cutting mechanism associated with each radially inner or outer chamber portion.

Although, in the above description, only one bag 13 is dispensed from the stack S during each cycle, it is clear that the same principle may be used for dividing up a large stack of wicketed bags into several smaller stacks by dispensing several bags at once.

I claim:

1. Apparatus for dispensing packaging bags from a wicketed bag stack, comprising:

(a) stack holder means including first wicket peg means extensible between a retracted position in which the wicket peg means are long enough to support the stack of bags and an extended position in which the wicket peg means project further beyond the stack, said wicket peg means being adapted to be driven between said retracted and extended positions;

(b) bag retainer means including second wicket peg means which have a spacing and a size corresponding to said first wicket peg means of the stack holder means, said retainer means further including a bucket to support the closed end of the bag and the product loaded therein;

(c) means indexing said bag retainer means to and from a bag-receiving position in which said second wicket peg means of the bag retainer means are coaxial with said first wicket peg means of the stack holder means and are a continuation of them in the extended position; and (d) means for separating from a stack held by the stack holder means the first bag of said bag stack which is nearer the bag-receiving position of said bag retainer means and for transporting said first bag along the first wicket peg means of the stack holder means while in their extended configuration, to pass directly on to the coaxial and engaging respective second wicket peg means of the bag retainer means, and (e) means for urging the closed end of said bag to flex over an edge of said bucket and into said bucket of the bag-receiving retainer means.

2. Apparatus according to claim 1, wherein said means for urging the closed end of the bag into the bucket comprises an air jet operating in conjunction with the bag transporting means.

3. Apparatus according to claim 1, wherein said bag separating means include a suction pad mounted for movement between positions in which it engages said stack to attract said first bag thereof and is advanced from said stack to transport said first bag which is engaged by said suction pad.

4. Apparatus according to claim 3, and including a rotatable carrier for said suction pad to allow said suction pad to move laterally clear of said first bag being separated from the stack and then to pass that first bag and to move laterally back into a position where the suction pad will engage the next successive bag of the stack.

5. Apparatus according to claim 1, wherein said bag separating and transporting means includes means directing an air jet at said first bag having been separated, for driving it along the extended first wicket peg means away from the stack.

6. Apparatus according to claim 1, wherein said bag transporting means includes means mechanically engaging behind the separated first bag for driving it along the extended first wicket peg means away from the stack.

7. A method of delivering individual bags from a wicketed stack of bags to bag receiving means comprising the steps of:

(i) supporting the wicketed stack on extensible wicket pegs;

(ii) extending the wicket pegs to engage further wicket pegs on to which bags are to be received;

(iii) urging the first bag of said stack along the extended wicket pegs to said further wicket pegs and (iv) further urging the bottom of said bag to flex over an edge of said receiver means and into said receiver means using air jet means.

* * * * *

UNITED STATES PATENT AND TRADEMARK OFFICE

CERTIFICATE OF CORRECTION

PATENT NO. : 5,029,728

DATED : July 9, 1991

INVENTOR(S) : Philip P. Su

It is certified that error appears in the above-identified patent and that said Letters Patent is hereby corrected as shown below:

In column 6, line 62 of the claims, delete "receiver means" substituting therefor --bucket--.

Signed and Sealed this

Twenty-fourth Day of November, 1992

*Attest:*

DOUGLAS B. COMER

*Attesting Officer*

*Acting Commissioner of Patents and Trademarks*